US006685450B2

(12) United States Patent
Bandis et al.

(10) Patent No.: US 6,685,450 B2
(45) Date of Patent: Feb. 3, 2004

(54) FLEXIBLE TUBE POSITIVE DISPLACEMENT PUMP

(75) Inventors: Steven Bandis, West Jordan, UT (US); LeVoy G. Haight, West Jordan, UT (US)

(73) Assignee: Sorenson Development, Inc., Salt Lake City, UT (US)

( * ) Notice: Subject to any disclaimer, the term of this patent is extended or adjusted under 35 U.S.C. 154(b) by 0 days.

(21) Appl. No.: 09/957,341

(22) Filed: Sep. 20, 2001

(65) Prior Publication Data

US 2002/0071776 A1 Jun. 13, 2002

Related U.S. Application Data

(60) Provisional application No. 60/234,739, filed on Sep. 22, 2000.

(51) Int. Cl.[7] ..... F04B 43/08
(52) U.S. Cl. ..... 417/477.6; 417/476
(58) Field of Search ..... 417/477.6, 477.3, 417/477.12, 63, 476, 319, 360; 210/90; 607/67, 131

(56) References Cited

U.S. PATENT DOCUMENTS

| | | | | |
|---|---|---|---|---|
| 2,794,400 A | | 6/1957 | Bodine, Jr. | |
| 3,749,531 A | | 7/1973 | Walker et al. | |
| 3,816,035 A | * | 6/1974 | Malbec | 417/477.6 |
| 3,942,915 A | * | 3/1976 | Thomas | 417/360 |
| 3,951,570 A | * | 4/1976 | Biaggi | 417/319 |
| 3,955,902 A | * | 5/1976 | Kyvgaard | 417/477.3 |
| 4,178,138 A | | 12/1979 | Iles | |
| 4,445,826 A | * | 5/1984 | Tarr | 417/476 |
| 4,498,843 A | | 2/1985 | Schneider et al. | |
| 4,522,571 A | * | 6/1985 | Little | 417/476 |
| 4,530,647 A | | 7/1985 | Uno | |
| 5,372,709 A | * | 12/1994 | Hood | 210/90 |
| 5,711,654 A | * | 1/1998 | Afflerbaugh | 417/63 |
| 5,871,341 A | * | 2/1999 | Melody | 417/477.6 |
| 5,941,696 A | * | 8/1999 | Fenstermacher et al. | 417/477.6 |
| 6,171,082 B1 | * | 1/2001 | Hankner et al. | 417/477.12 |
| 6,203,528 B1 | * | 3/2001 | Deckert et al. | 604/131 |
| 2002/0107477 A1 | * | 8/2002 | Kipfer | 604/67 |

FOREIGN PATENT DOCUMENTS

| | | | | |
|---|---|---|---|---|
| GB | 2069063 | * | 8/1981 | F04B/43/12 |

* cited by examiner

*Primary Examiner*—Sang Y. Paik
*Assistant Examiner*—Leonid Fastovsky
(74) *Attorney, Agent, or Firm*—TraskBritt

(57) ABSTRACT

The pressure rollers of a peristaltic tube positive displacement pump are incorporated as an element of a reduction system connecting a drive shaft to the rollers.

17 Claims, 5 Drawing Sheets

FLEXIBLE TUBE POSITIVE DISPLACEMENT PUMP

Priority claim: This application claims the benefit of U.S. Provisional Application No. 60/234,739, filed Sep. 22, 2000.

BACKGROUND OF THE INVENTION

1. Field

This invention relates to fluid transfer by means of flexible tube displacement pumps. It is particularly directed to an improved positive displacement peristaltic pump, especially useful for medical applications.

2. State of the Art

Positive displacement pumps of various types are well known. Among such devices is a category known as "flexible tube pumps." Such pumps rely upon one or more traveling pressure elements, typically rollers or shoes, pressing against a flexible tube to displace its fluid contents. The traveling elements are carried by a rotor which is powered by an external transmission.

Flexible tube, positive displacement peristaltic pumps have been utilized for low volume fluid transport. In a typical construction, the pressure rollers of such pumps are mounted to revolve within a pump housing at the distal ends of rotor arms. The rollers are mounted on axes transverse the plane on which they revolve, and press against a flexible tube, thereby urging fluid in the tube to move in the direction of roller travel. Positive displacement pumps typically run at low speeds. Accordingly, the rollers are not directly powered; rather, the rotor arms are powered by a drive mechanism external the pump housing. The drive mechanism incorporates a significant gear reduction or a mechanically equivalent speed reducing arrangement.

A positive displacement pump is typically primed by connecting its inlet to a fluid supply, and then running the pump to displace any entrapped air. This process takes time, which is often inconvenient, and in some medical applications, may be life threatening.

The fluid transfer rate of a positive displacement pump is proportional to the speed of rotation of the rotor carrying the traveling pressure elements. Various mechanisms have been utilized to detect this speed. If the pump is operated in pulse mode; i.e., with the pump operating during spaced intervals, the number of rotations during each pulse is of specific importance. Mechanical counters are generally useful for this purpose, but have certain disadvantages. They are irritatingly noisy in medical applications, and they introduce some frictional resistence, which can be problematic in low energy pump applications, generally.

BRIEF SUMMARY OF THE INVENTION

This invention comprises a positive displacement peristaltic pump which incorporates a gear reduction system, or the equivalent, within the pump housing. Moreover, the pressure roller (or rollers) within the housing is driven, and thereby constitutes an element of the reduction system. This arrangement reduces the parts count, cost and space requirements of the pump assembly.

Practical constructions combine one or more eccentric gears from a planetary gear system with a roller arranged to press against a peristaltic tubing, thereby causing pumping action to occur. This arrangement combines eccentric gear reduction and pumping into a single compact cassette, thereby reducing part count and cost. The tubing-to-roller junction also contributes to gear reduction, which increases torque within the system.

The overall gear reduction of the assembly may be divided between components positioned within and outside the housing, depending upon the requirements of a particular application. In any case, incorporating the pressure rollers of the system as a portion of the reduction system constitutes a significant improvement. While pump assemblies constructed in accordance with this invention offer advantages for many applications, one embodiment of particular interest currently is structured as an ambulatory infusion pump for pain management. This structure can readily be adapted to other medical applications requiring the administration of medicaments at low dosage rates on a continuous (including steady, but intermittent) basis.

It is economically practical to construct pumps in accordance with this invention for single use (disposable) applications. While medical applications are emphasized in this disclosure, the avoidance of contamination is desirable in other commercial or laboratory settings, and pumps constructed in harmony with the teachings of this disclosure are suitable for many such applications. It is generally advantageous for these pumps to be capable of rapid priming. The pump may thus be provided as an assembly, structured and arranged to hold the pressure rollers substantially out of contact with the flexible tubing comprising the pump chamber until deliberate force is applied to move those components into normal pumping association. The original such assembled condition permits unimpeded fluid flow through the tube, thereby enabling almost instantaneous priming of the pump. The second condition places the pump in pumping mode. Moving the rollers into the second assembled condition may be regarded as the final step in assembling the pump, and may be deferred until the pump is put into service.

The improvement of this invention may thus be regarded as a new arrangement of components for a peristaltic pump system in which rotating pressure elements are driven by a reduction system and are structured and arranged to revolve through a chamber in contact with a flexible tube. According to this invention, the pressure elements are incorporated into the reduction system. The pressure elements will usually comprise rotating pressure rollers driven by a gear reduction system. The pressure rollers are structured and arranged to revolve through a chamber with the outer surfaces of the rollers constituting pressure surfaces in contact with a flexible tube adjacent a reaction surface. Travel of the rollers causes positive displacement pumping action through the tube. The rollers are preferably mounted in roller assemblies in association with follower gears. The follower gears may be arranged to receive rotational force from a drive gear, which in turn receives power through a driven shaft element.

The pump system may include a first assembly comprising the driven shaft element; a second assembly comprising the pressure rollers; and a coupling mechanism associated with the reduction system constructed and arranged to transfer power from the driven shaft element to the pressure elements. The second assembly desirably includes a pair of structural members, the first of which includes a reaction surface. The flexible tube pumping chamber may then be mounted adjacent this reaction surface. The second structural member may carries the pressure rollers. Connection means associated with the first and second structural members are constructed and arranged to provide a first, priming, position of the rollers with respect to the reaction surface and a second, pumping, position of the rollers with respect to the reaction surface.

Ideally, the reaction surface is formed as a generally conical segment with a cone axis congruent with the axis of the driven shaft, and the rollers include generally frusto conical segments, and are mounted to turn on respective roller axes, each of which is approximately parallel the cone axis. The connection means may then be operable to adjust the spacing between the reaction surface and the pressure surfaces of the rollers such that the spacing (which captures the flexible tube) is relatively larger in the priming position and relatively smaller in the pumping position. A preferred arrangement of the connection means positions the first and second structural members in the priming position by holding the rollers in a first axial location with respect to the reaction surface. The connection means further accommodates relative axial movement of the first and second structural members into the pumping position, thereby moving the rollers into a second axial location with respect to the reaction surface. The first structural member may comprise a cassette body element and the second structural member may comprises a portion of a cassette housing. The first and second structural members may then be cooperatively adapted to couple together temporarily into the priming position during an assembly operation, and to be pressed permanently into the pumping position following priming of the flexible tube. This second positioning (into the pumping position) is conveniently accomplished in the field, such as in a clinical setting.

A typical dosage rate for pump assemblies applied to medical applications is less than about 50 $\mu$l (micro liters) per pump rotor revolution, and such pumps are ordinarily operated to deliver outputs of less than about 100 ml (milliliters) per hour. A typical pump speed for such applications is about 60 rpm (revolutions per minute), with 600 rpm being about the maximum practical speed for pump assemblies of this scale. Of course, these scale and operating parameters are not critical to the operability of the pump assembly. More significantly, it is practical to construct assemblies within these parameters, in accordance with this invention, at low cost and within a relatively small volume, or envelope.

The pumps of this invention generally operate at a constant speed when in the "on" condition. Throughput is thus controlled as a function of "on"/"off" pulsed operation. Pulses are relied upon to distribute a specified dose over a prescribed time; typically a 24-hour period. Certain preferred embodiments of this invention incorporate an optical sensing arrangement constructed and arranged to count the number of rotations of the rotor arms during each pulse of operation. The data accumulated in this fashion can be processed, electronically or otherwise, to maintain a precisely controlled fluid delivery rate through the pump. An electronic control system associated with the drive motor for the pump may be programmed in conventional fashion to maintain a prescribed steady or variable delivery rate as desired.

BRIEF DESCRIPTION OF THE SEVERAL VIEWS OF THE DRAWINGS

In the drawings, which illustrate what is currently regarded as the best mode for carrying out the invention.

Figure 1:
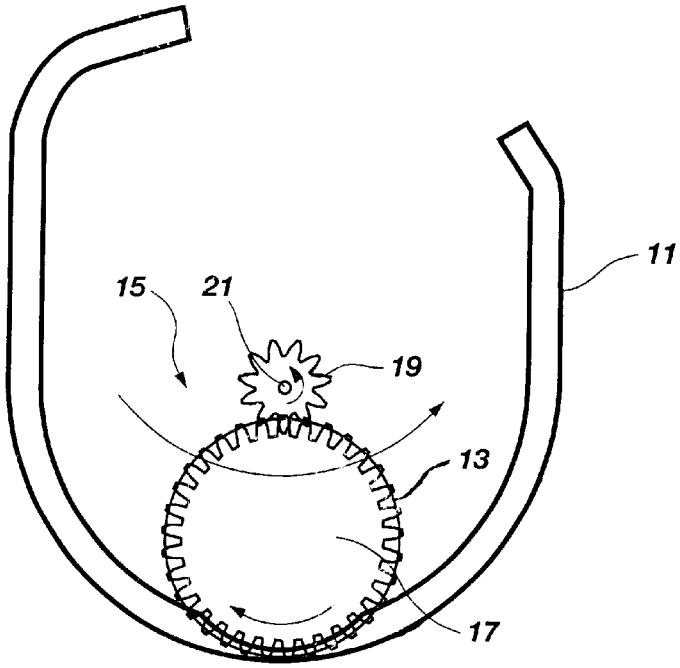
FIG. 1 is a schematic illustration of a first embodiment of the invention.

The reference numerals on the drawings refer, respectively, to the following features:

11 fixed flexible peristaltic tube pump chamber
13 roller component
15 follower assembly
17 gear component
19 drive gear
21 drive shaft
23 idler
25 first follower assembly
27 second follower assembly
30 ambulatory infusion pump assembly
31 drive section
32 top cover portion
33 bottom cover portion
34 gear motor
34A motor shaft
36 batteries
40 cassette subassembly
41 run/pause control button
42 bolus control button
43 first PC board contacts
44 second PC board contacts
45 PC board
46 Spring battery contacts
47 LED display
48 display cover
49 pressure sensor contact
50 pressure sensor adjustor
51 pressure sensor button
52 pressure adjustment screw
52A speaker
53 pinion gear
54 spur gear
55 first molded fittings
56 second molded fittings
58 battery cap
59 battery cap contact
62 cassette body
66 cassette cap
66 cassette bottom
70 roller gears
70A roller gear pressure segment
70B roller gear tooth segment
72 gear link assembly
72A first gear link assembly half
72B second gear link assembly half
74 tube roller
74A tube roller ridge
74B tube roller support surface
76 hole in the cassette bottom
78 cassette cover tab
78A latching surface
80 drive section housing socket
82 optical sensor reflector
84 snap tab
85 receiver

86 first latch surface
87 second latch surface

DETAILED DESCRIPTION OF THE INVENTION

Figure 2:
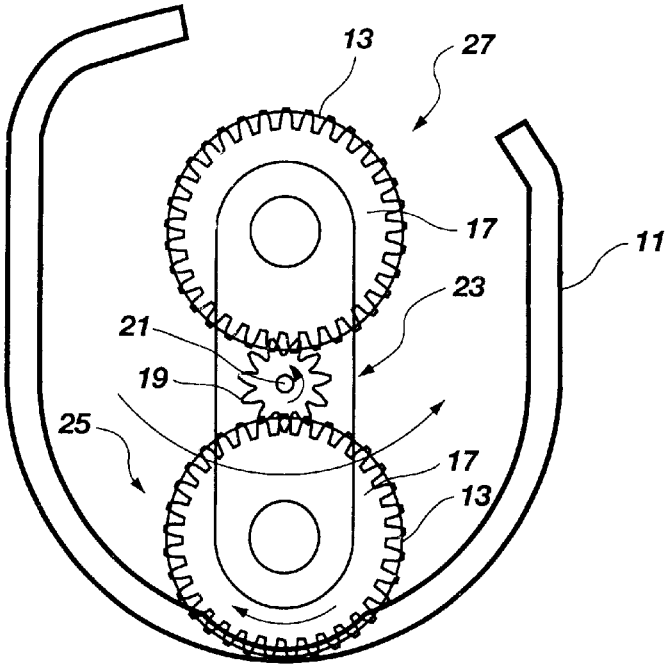
FIG. 2 is a schematic illustration of a second, generally preferred embodiment of the invention.

FIG. 1 illustrates the basic components of the invention. A fixed, peristaltic tube 11 (pump chamber) is contacted and pinched by a roller component 13 of a follower assembly 15. The assembly 15 also includes a gear component 17, which is driven by a drive gear 19 which receives power from a drive shaft 21. A currently preferred arrangement is illustrated by FIG. 2. In that instance, the drive gear 19 is associated with an idler 23 positioned generally as the rotor arm of a conventional peristaltic flexible tube pump. As illustrated, however, the drive gear 19 transmits rotational force to a pair of follower assemblies 25, 27, imparting a speed reduction. That is, each follower assembly crawls along the tube 11, rather than being pushed along the tube 11 in conventional fashion.

Figure 3:
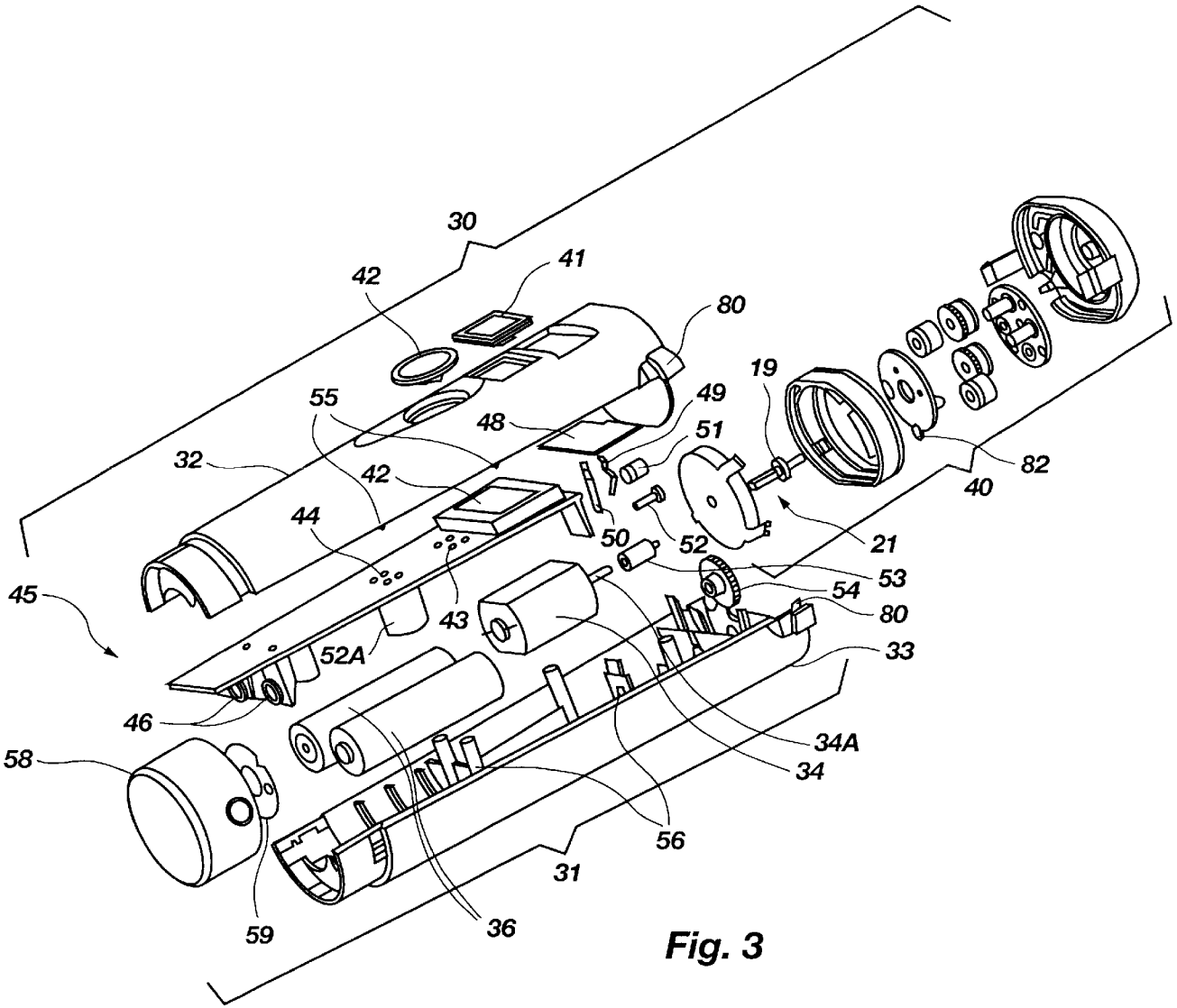
FIG. 3 is an exploded pictorial illustration of a pump assembly including a cassette subassembly incorporating the improvement of this invention.
Figure 4:
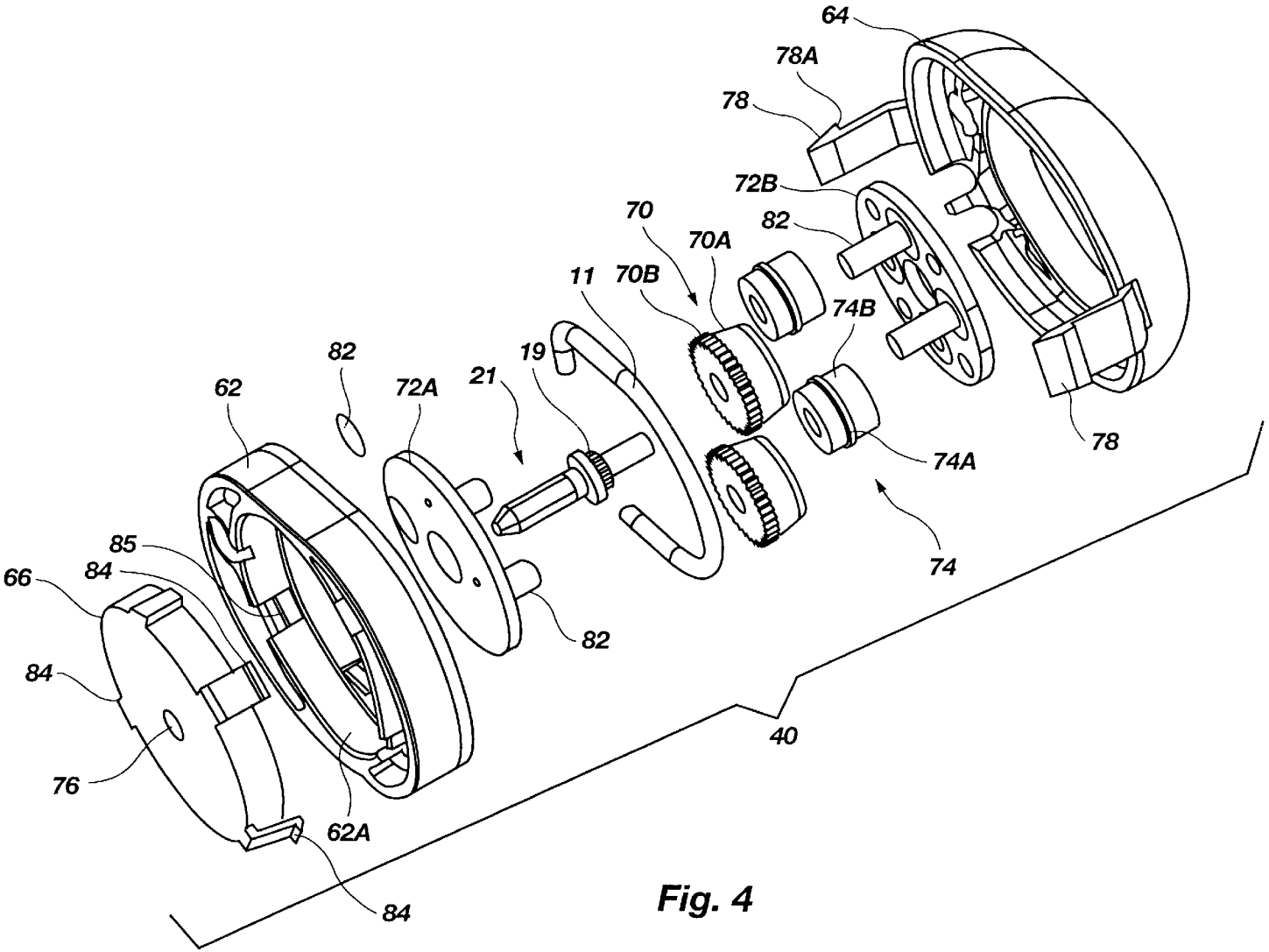
FIG. 4 is an exploded pictorial view of the cassette subassembly of FIG.3, rendered at an enlarged scale.

Referring to FIGS. 3 and 4, an ambulatory infusion pump assembly, generally 30, includes a drive section, generally 31, enclosed within a top cover portion 32 and a bottom cover portion 33. The drive section 31 includes a small gear motor 34, a power supply (batteries 36) and other "non-disposable" components of the assembly 30. Of course, the entire assembly 30 may be either disposable or reusable. The preferred embodiment illustrated, however, contemplates reuse of the components of the drive section 31 and discard of the components contained within an associated cassette assembly, generally 40 (See FIG. 4).

A run/pause control button 41 and a bolus control button 42 are associated with the top cover segment 32, as shown. These control buttons function by being pressed against contacts 43, 44 on the upper surface of PC board 45. Other components associated with the drive section 31 and its contained PC board 45, include spring battery contacts 46, an LED display 47 and its cover 48, a pressure sensor contact 49, a pressure sensor adjustor 50, a pressure sensor button 51 and a pressure adjustment screw 52. A speaker 52A, and other circuit components are mounted on the PC board 45 in conventional fashion, as required to implement the pumping protocols, monitoring functions, warning signals, etc. required for any particular application.

The motor 34 carries a motor pinion gear 53 on its shaft 34A. A significant gear reduction is effected through the linkage of the pinion gear 53 to the cassette shaft 21 through the spur gear 54.

The top 32 and bottom 33 portions of the drive housing are connected together by molded fittings 55, 56. A battery cap 58, which also houses a battery cap contact 59, is mounted on one end of the assembled housing. This cap adds integrity to the assembly, and also functions as an on/off switch for the drive section 31. The cap 58 may be structured for occasional removal for battery replacement.

As best shown by FIG. 4, the cassette assembly 40, which comprises the improvements of most significance to this invention, includes a cassette body 62, a cassette cap 64 and a cassette bottom 66, which together house and support other components of the system. As illustrated, a pair of roller gears 70, each of which has a conical pressure surface 70A and a gear tooth segment 70B, are mounted within a gear link assembly, 72 comprising mutually opposed halves 72A, 72B. A pair of tube rollers 74 is similarly mounted within the gear link assembly 72. Each roller 74 has an annular ridge 74A and an adjacent support segment 74B. With the cassette assembled, as shown by FIGS. 5–8, the cassette shaft 21 extends through the hole 76 in the cassette bottom 66. With the pump assembly 30 in fully assembled condition, the cassette 40 is held in removable association with the drive assembly 30 by means of tabs 78 carried by the cassette cover 64 registering with sockets 80 formed by the connection of the upper 32 and lower 33 cover portions of the drive assembly 31

Figure 5:
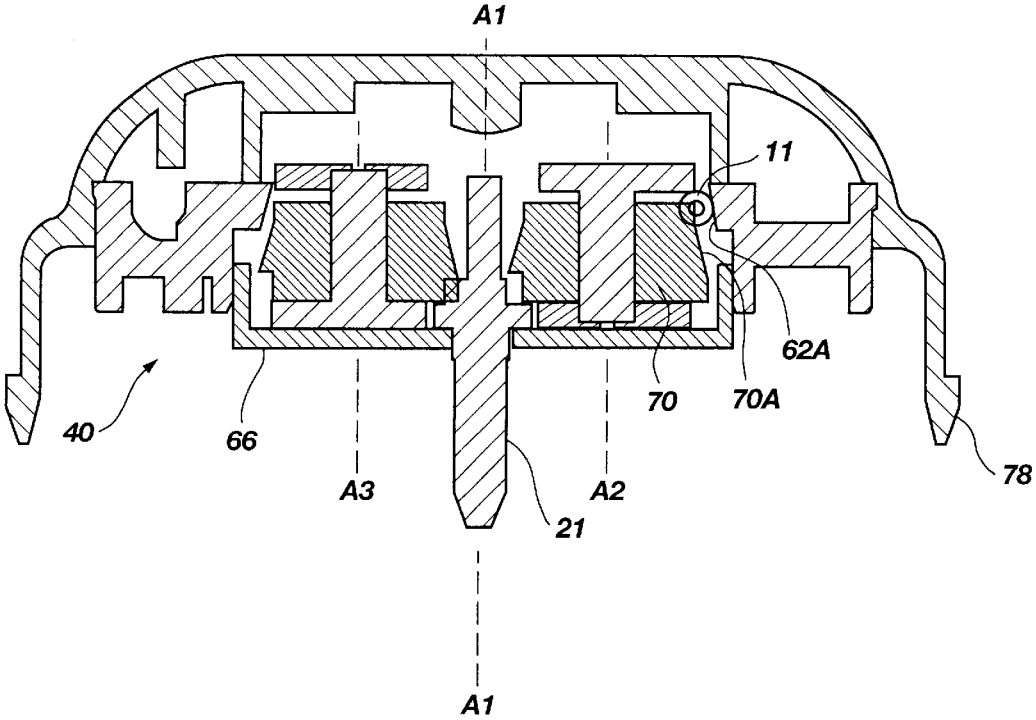
FIG. 5 is a cross sectional view of a portion of the cassette subassembly of FIG. 4, rendered at a further enlarged scale, showing the internal components in pump priming condition.
Figure 6:
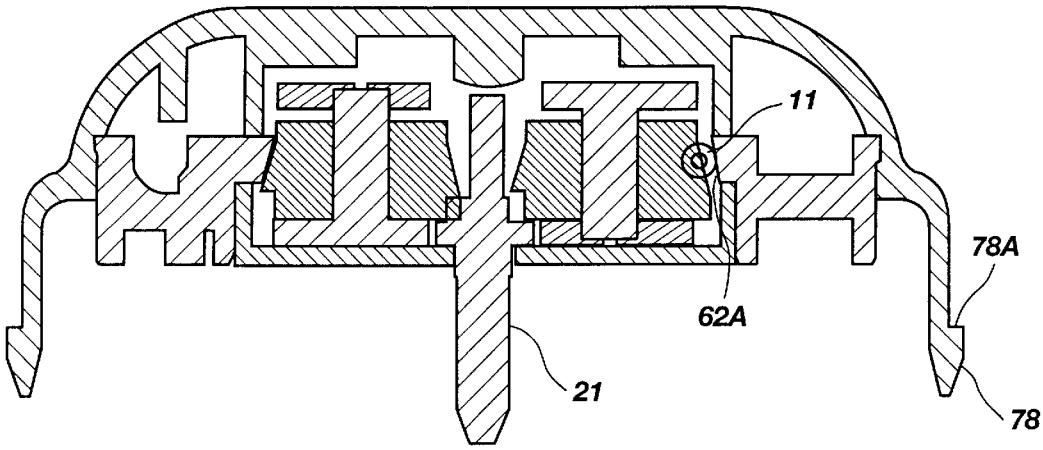
FIG. 6 is a view similar to FIG. 5 showing the internal components in pumping condition.
Figure 7:
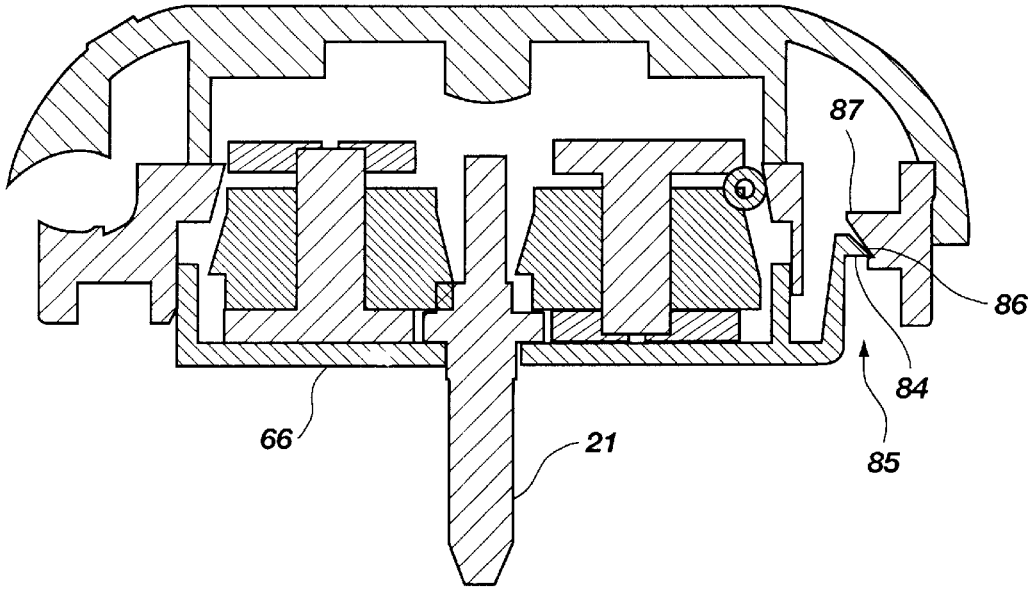
FIG. 7 is a cross sectional view similar to FIG. 5 as viewed at a different reference plane.
Figure 8:
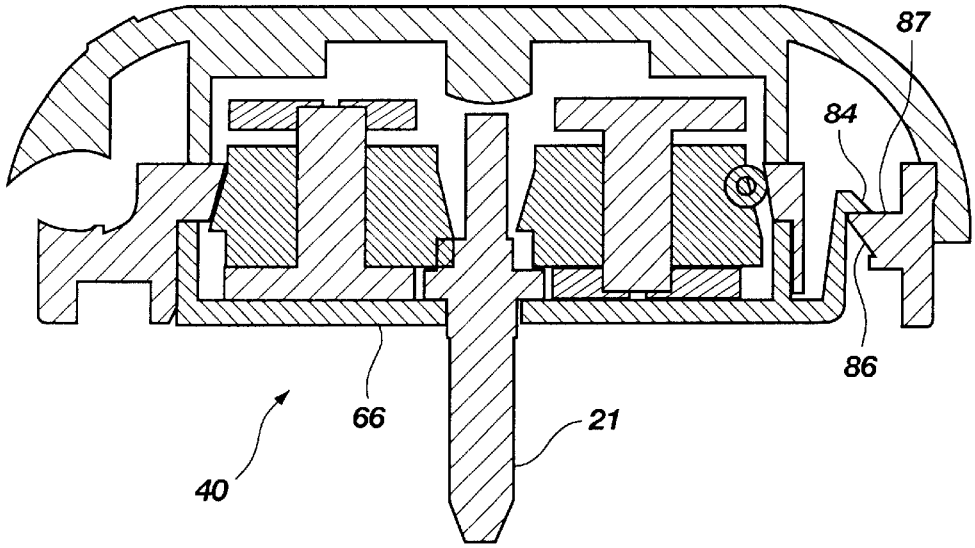
FIG. 8 is a view similar to FIG. 6, as viewed at the reference plane of FIG. 7.

Four spindles 82 within the gear link assembly 72 serve as axles for the gears 70 and rollers 72, which are mounted on alternate such spindles. A peristaltic tube pump chamber 11 (See also FIGS. 1 and 2) is positioned within the cassette body 62 adjacent the reaction surface 62A, which is tapered (as a conical segment) and extends somewhat more that 180 degrees. With the cassette assembled as shown by FIGS. 5–8, the tube 11 is positioned between this reaction surface 62A and the pressure surfaces 70A of the roller gears 70. These surfaces 70A are also tapered, defining a frusto conical roller segment, and are approximately parallel the reaction surface 62A at their respective contacts with the tube 11. When the pressure segments 70A of roller gears 70 are positioned as shown by FIGS. 5 and 7, in priming condition, fluid may flow freely through the tube, facilitating rapid priming. The rotating drive gear 19 engages the tooth segments 70B of roller gears 70. When the pressure segments 70A of roller gears 70 are positioned as shown by FIGS. 6 and 8, in pumping contact with the tube 11, the roller gears crawl along the tube 11, displacing fluid in the direction of travel. The gear link 72 is thereby caused to rotate within the cassette body 62, carrying the tube rollers 74 in procession between the roller gears 70. The ridges 74A of the rollers 74 hold the tube 11 in proper position as the pressure surface 70A of a leading roller gear 70 leaves contact with the tube 11 and prior to contact of the tube 11 by a trailing roller gear 70.

An optical sensor reflector 82 carried by gear link segment 72A constitutes means for detecting each rotations of the gear link. This data may be processed by conventional optical detector circuitry within the drive assembly 31. The dosage rate may be displayed in any selected format or protocol by the LED display 47.

FIG. 5 illustrates the assembled cassette 40, with its bottom 66 in a first axial (priming) position along the cone axis Al. The "cone axis" A1 is a feature of the inclined conical reaction surface 62A. The roller gears 70 are mounted to rotate around respective roller axes A2, A3, which are approximately parallel the cone axis A1. In priming position, the pressure surfaces 70A are held sufficiently spaced from the reaction surface 62A to permit free flow of liquid through the tube 11. In usual practice, the tube will be "primed" prior to advancing the cassette bottom 66 to its second axial (pumping) position along the cone axis Al, as illustrated by FIG. 6. The cassette subassembly 40 will then be mounted to the drive subassembly 31 by plugging the tabs 78 into the sockets 80 (FIG. 3). As a consequence, the cassette shaft 21 will register with the spur gear 54. Operation of the motor 34 will then cause the roller gears to revolve around the cone axis Al while rotating around their respective roller gear axes A2, A3 in pinching relationship with the tube 11.

FIGS. 7 and 8 illustrate the internal components of the cassette subassembly 40 in the same relative positions illustrated by FIGS. 5 and 6, respectively. The cross section is rotated, however, to illustrate one mechanism for mounting the cassette bottom 66 in its priming (FIG. 7) and pumping (FIG. 8) positions. As illustrated, the cassette bottom 66 carries a plurality of resilient tabs 84 positioned to register with receivers 85. Partial insertion of the tabs 84 effects a locking engagement with a first latch surface 86 corresponding to the priming position. Prior to mounting the cassette subassembly 40 to the drive subassembly 31, the cassette bottom 66 is urged axially to the pumping position illustrated by FIG. 8. If the pumping chamber (tube 11) has been primed, pumping can commence immediately. If not, priming can be done by introducing fluid to the inlet end of the tube 11 while operating the motor, eventually displacing entrapped air from the tube 11.

For most medical, and certain other, applications, the cassette subassembly 40 is removed from the drive subassembly 31 following use. The tabs 78 are resilient, and may be pressed to disengage the latching surfaces 78A from the sockets 80. The drive subassembly 31 may then be reused indefinitely with replacement cassette subassemblies 40.

Reference in this disclosure to the details of preferred or illustrated embodiments in not intended to limit the scope of the invention defined by the appended claims, which themselves recite those features regarded as significant to the invention.

What is claimed is:

1. In a peristaltic pump system in which rotating pressure elements are driven by a reduction system and are structured and arranged to revolve through a chamber in contact with a flexible tube, the improvement comprising a reaction surface, positioned opposite said rotating pressure elements, said flexible tube being positioned intermediate said rotating pressure elements and said reaction surface, said flexible tube being compressed by said rotating pressure elements and said reaction surface, each of said pressure elements having a respective follower gear secured thereto, each said follower gear being intercooperated with a drive gear and further being incorporated into said reduction system.

2. In a peristaltic pump system in which rotating pressure rollers are driven by a gear reduction system and are structured and arranged to revolve through a chamber with the outer surfaces of said rollers constituting pressure surfaces in contact with a flexible tube, whereby to cause positive displacement pumping action through said tube, the improvement comprising a reaction surface, positioned opposite said rotating pressure elements, said flexible tube being positioned intermediate said rotating pressure elements and said reaction surface, said flexible tube being compressed by said rotating pressure rollers and said reaction surface each of said pressure rollers having a respective follower gear secured thereto, each said follower gear being intercooperated with a drive gear and further being incorporated into said gear reduction system.

3. An improvement according to claim 2, wherein said follower gears are dimensioned relative to said drive gear to produce a reduction in rotational velocity of said rollers relative to said drive gear said follower gears being arranged to receive rotational force from said drive gear which receives power through a driven shaft element.

4. An improvement according to claim 2, wherein said pump system includes a first subassembly comprising said driven shaft element;

a second subassembly comprising said pressure rollers; and a coupling mechanism associated with said reduction system, whereby to transfer power from said driven shaft element to said pressure elements.

5. An improvement according to claim 4, wherein said second subassembly includes:

a first structural member including a first reaction surface;

said flexible tube mounted adjacent said first reaction surface;

a second structural member carrying said pressure rollers and connection means associated with said first and second structural members, said connection means being constructed and arranged to provide a first, priming, position of said rollers with respect to said first reaction surface and a second, pumping, position of said rollers with respect to said first reaction surface.

6. An improvement according to claim 5, wherein said first reaction surface is generally conical with a cone axis congruent with the axis of said driven shaft and said rollers are generally conical and mounted to turn on respective roller axes, each of which is approximately parallel said cone axis, said connection means being operable to adjust the spacing between said first reaction surface and the surfaces of said rollers such that said spacing is relatively larger in said priming position and relatively smaller in said pumping position.

7. An improvement according to claim 6, wherein said connection means is constructed and arranged for;

positioning said first and second structural members in said priming position with said rollers in a first axial location with respect to said first reaction surface; and accommodating relative axial movement of said first and second structural members into said pumping position, thereby moving said rollers into a second axial location with respect to said first reaction surface.

8. An improvement according to claim 7, wherein said first structural member comprises a cassette body element, said second structural member comprises a portion of a cassette housing, and said first and second structural members are cooperatively adapted to couple together temporarily into said priming position during an assembly operation, and to be pressed permanently into said pumping position following priming of said flexible tube.

9. An improvement according to claim 2, including an optical sensor constructed and arranged to count the number of revolutions of said rollers through said chamber during a duty cycle.

10. A peristaltic pump system, comprising:

rotating pressure rollers, each pressure roller incorporating a respective follower gear, each said respective follower gear being meshed with a drive gear, each said respective follower gear being incorporated within and constituting an element of a gear reduction system structured and arranged to revolve through a chamber with the outer surfaces of said rollers constituting pressure surfaces in contact with a flexible tube, whereby to cause positive displacement pumping action through said tube, and a reaction surface, positioned opposite said rotating pressure elements, said flexible tube being positioned intermediate said rotating pressure elements and said reaction surface, said flexible tube being compressed by said rotating pressure elements and said reaction surface.

11. A system according to claim 10, wherein said follower gears are dimensioned relative to said drive gear to produce a reduction in rotational velocity of said rollers relative to said drive gear; said follower gears being arranged to receive rotational force from said drive gear which receives power through a driven shaft element.

12. A system according to claim 10, wherein said pump system includes a first subassembly comprising said driven shaft element;

a second subassembly comprising said pressure rollers; and a coupling mechanism associated with said reduction system, whereby to transfer power from said driven shaft element to said pressure elements.

13. A system according to claim 12 wherein said second subassembly includes:

a first structural member including a first reaction surface;

said flexible tube mounted adjacent said first reaction surface;

a second structural member carrying said pressure rollers and connection means associated with said first and second structural members, said connection means being constructed and arranged to provide a first, priming, position of said rollers with respect to said first reaction surface and a second, pumping, position of said rollers with respect to said first reaction surface.

14. A system according to claim 13, wherein said first reaction surface is generally conical with a cone axis congruent with the axis of said driven shaft and said rollers are generally conical and mounted to turn on respective roller axes, each of which is approximately parallel said cone axis, said connection means being operable to adjust the spacing between said first reaction surface and the surfaces of said rollers such that said spacing is relatively larger in said priming position and relatively smaller in said pumping position.

15. The system according to claim 14, wherein said connection means is constructed and arranged for;

positioning said first and second structural members in said priming position with said rollers in a first axial location with respect to said first reaction surface; and accommodating relative axial movement of said first and second structural members into said pumping position, thereby moving said rollers into a second axial location with respect to said first reaction surface.

16. The system according to claim 15, wherein said first structural member comprises a cassette body element, said second structural member comprises a portion of a cassette housing, and said first and second structural members are cooperatively adapted to couple together temporarily into said priming position during an assembly operation, and to be pressed permanently into said pumping position following priming of said flexible tube.

17. The system according to claim 10 wherein said reaction surface is stationary relative to said pressure rollers.

* * * * *